US005815589A

United States Patent [19]

Wainwright et al.

[11] Patent Number: 5,815,589

[45] Date of Patent: Sep. 29, 1998

[54] PUSH-PULL TRANSMISSION LINE LOUDSPEAKER

[76] Inventors: Charles E. Wainwright, 17400 Rocky Gorge Ct., Silver Spring, Md. 20905; James N. Birks, 7244 Mink Hollow Rd., Highland, Md. 20777

[21] Appl. No.: 802,426

[22] Filed: Feb. 18, 1997

[51] Int. Cl.[6] ..... H04R 25/00; H04R 1/02; H04R 9/08

[52] U.S. Cl. ..... 381/346; 381/353; 381/349; 381/340; 381/338; 381/341; 181/155; 181/144; 181/146

[58] Field of Search ..... 381/86, 156, 158, 381/88, 89, 90, 353, 354, 349; 181/144, 145, 146, 155, 156

[56] References Cited

U.S. PATENT DOCUMENTS

| | | | |
|---|---|---|---|
| 2,975,852 | 3/1961 | Chave | 181/155 |
| 3,987,258 | 10/1976 | Tsutsui et al. | 181/155 |
| 4,064,966 | 12/1977 | Burton | 181/155 |
| 4,085,289 | 4/1978 | Schmideler | 381/86 |
| 4,112,256 | 9/1978 | Carlsson | 381/332 |
| 4,210,223 | 7/1980 | Gillum et al. | 181/152 |
| 4,268,719 | 5/1981 | Manger | 181/144 |
| 4,324,313 | 4/1982 | Nakagawa | 181/192 |
| 4,348,549 | 9/1982 | Berlant | 181/155 |
| 4,426,552 | 1/1984 | Cowans et al. | 381/100 |
| 4,439,644 | 3/1984 | Bruney, III | 381/349 |
| 4,466,505 | 8/1984 | Ritter | 181/144 |
| 4,558,672 | 12/1985 | Carlsson | 181/147 |
| 4,598,789 | 7/1986 | Ritter | 181/144 |
| 4,653,103 | 3/1987 | Mori et al. | 381/117 |
| 4,733,749 | 3/1988 | Newman et al. | 181/144 |
| 4,750,585 | 6/1988 | Collings | 181/148 |
| 4,790,408 | 12/1988 | Adair | 181/152 |
| 4,811,403 | 3/1989 | Henricksen et al. | 381/87 |
| 4,837,837 | 6/1989 | Taddeo | 181/151 |
| 4,923,031 | 5/1990 | Carlson | 181/144 |
| 4,953,655 | 9/1990 | Furukawa | 181/346 |
| 4,991,687 | 2/1991 | Oyaba et al. | 181/145 |
| 5,073,945 | 12/1991 | Kageyama et al. | 381/349 |
| 5,170,435 | 12/1992 | Rosen et al. | 381/86 |
| 5,187,333 | 2/1993 | Adair | 181/152 |
| 5,343,535 | 8/1994 | Marshall | 381/349 |
| 5,373,564 | 12/1994 | Spear et al. | 381/159 |
| 5,374,124 | 12/1994 | Edwards | 381/88 |
| 5,388,162 | 2/1995 | Sohn | 181/146 |
| 5,525,767 | 6/1996 | Fields | 181/155 |
| 5,749,433 | 5/1998 | Jackson | 181/156 |

FOREIGN PATENT DOCUMENTS

| | | | |
|---|---|---|---|
| 56-129496 | 10/1981 | Japan | 381/88 |

*Primary Examiner*—Paul Loomis
*Assistant Examiner*—Rexford N. Barnie
*Attorney, Agent, or Firm*—Rothwell, Figg, Ernst & Kurz

[57] ABSTRACT

A loudspeaker system having a multiple driver array arranged in a push-pull configuration is loaded into an acoustic transmission line ported to the outside of the loudspeaker enclosure. The transmission line is preferably tapered and is filled with acoustic damping material. The combination of the push-pull driver configuration loaded into an acoustic transmission line produces a high performance, spatially enhanced sound reproduction.

13 Claims, 4 Drawing Sheets

PUSH-PULL TRANSMISSION LINE LOUDSPEAKER

BACKGROUND OF THE INVENTION

Field of the Invention

The present invention relates to loudspeakers and loudspeaker systems for the high fidelity reproduction of sound.

Background and Prior Art

In the 1920s, discoveries were made which allowed sound waves to be recorded and reproduced with the use of electrical signals. Before that time, the record player worked on purely mechanical principles. As the pick-up needle traced the groove in the record, the mechanical vibrations of the needle were coupled to a flared horn mounted on top of the device. The vibrations were amplified by the horn, and sounds were thus produced directly, with the volume of sound reproduction being a function of the size of the acoustic horn. As a consequence, the volume and quality of sound was limited by the use of the acoustic horn and its practical size limitations.

Later, pick-ups were made which converted mechanical vibrations into electrical signals, and thus became known as transducers. Such an electrical signal could be amplified by the newly developed vacuum tube amplifier, but it could not be applied to the acoustic horn. Hence, a transducing device was needed which could convert electrical signals back into sound waves. This is the function of the conventional loudspeaker.

The basic requirements of a dynamic loudspeaker are a circular or elliptical diaphragm or cone (also sometimes known as a dome), which is freely suspended from a metal frame both around its edge and near its center. Attached to the center of the cone is a wound coil of wire known as a voice-coil, which is positioned between the poles of a magnet. When an electrical signal is applied to the voice-coil, a magnetic force is generated which is opposed by the permanent force of the magnet. Because the voice-coil is rigidly attached to the diaphragm, this force causes the diaphragm to move. The movements of the diaphragm closely follow the variations in the electrical signal and cause sound waves to be produced in the air. The more closely the movements of the diaphragm are able to follow the variations in the electrical signal, the more accurate will be the reproduced sound.

Certain problems arose with the radiation of sound waves of frequencies extending throughout the audible range, which is about 30 to 16,000 Hz. First, the sound from the rear surface of the diaphragm had to be isolated from the sound coming from the front surface, otherwise sounds leaving both surfaces would cancel each other out. Secondly, at high frequencies, sounds are not equally radiated in all directions but become focused in a narrow beam. In order to improve reproduction quality and efficiency at low or bass frequencies, a loudspeaker is mounted in an enclosure or cabinet.

Various types of loudspeaker enclosures are known. A popular example is the acoustic suspension type of enclosure. An acoustic suspension enclosure is a sealed cabinet in which a loudspeaker is mounted, and which is filled with sound absorbing material to isolate sound from the rear surface of the diaphragm. Acoustic suspension type enclosures exhibit good bass response but are inefficient in that they require more power from the amplifier to reproduce a given sound level.

Other types of known enclosures are designed to make use of the rear surface sound radiation such that it acts to enhance the sound reproduction from the loudspeaker. One example of this type of enclosure is a tuned or reflex enclosure, in which a vent or port at the front magnifies sound pressure at a specifically tuned frequency range. Another type of known enclosure is a transmission line enclosure, which has been used to guide rear surface sound radiation to the outside of the speaker cabinet in such manner that it augments the front surface radiation.

Loudspeaker arrangements for increasing efficiency and isolating rear surface radiation are also known. One example is a so-called push-pull arrangement, as described in U.S. Pat. No. 4,016,953 to Butler, incorporated by reference herein in its entirety. The push-pull arrangement of the '953 patent consists of a pair of loudspeakers mounted face to face with an airtight connection therebetween. The voice-coils of the two loudspeakers are connected in an out of phase relationship, that is, the positive terminal of the first speaker is connected to the negative terminal of the second speaker and the negative terminal of the first speaker is connected to the positive terminal of the second speaker. An audio source is then connected to the terminals of either speaker. In this way, the two loudspeakers act together as a unit. That is, when the front surface of one speaker diaphragm is deflected in one direction, the rear surface of the other diaphragm is deflected in the same direction, and vice versa. As such, the sound wave radiation from the two loudspeakers will be in the same direction.

While the known push-pull arrangement exhibits increased performance and/or power handling capacity, there remains a need in the art for achieving increased frequency response, higher efficiency, reduction of harmonic distortion, and increased presence over the existing loudspeaker technology.

SUMMARY OF THE INVENTION

The present invention provides a loudspeaker system which achieves a substantial improvement over the prior art with respect to each of the above-mentioned parameters, and which exhibits superior performance characteristics, enhanced spatial effects, and improved mechanical attributes over known loudspeaker designs.

In particular, the present invention provides a loudspeaker system, comprising an enclosure, a transducer mounted in the enclosure and comprising at least two drivers arranged in a push-pull configuration and mounted to have an airtight coupling therebetween, and an acoustic transmission line provided within the enclosure, the transmission line being coupled to the transducer and functioning as a load on the transducer.

Other features of the improved loudspeaker system of the present invention will become apparent from the following detailed description of preferred embodiments taken in connection with the accompanying drawings.

DETAILED DESCRIPTION OF THE PREFERRED EMBODIMENTS

Figure 1:
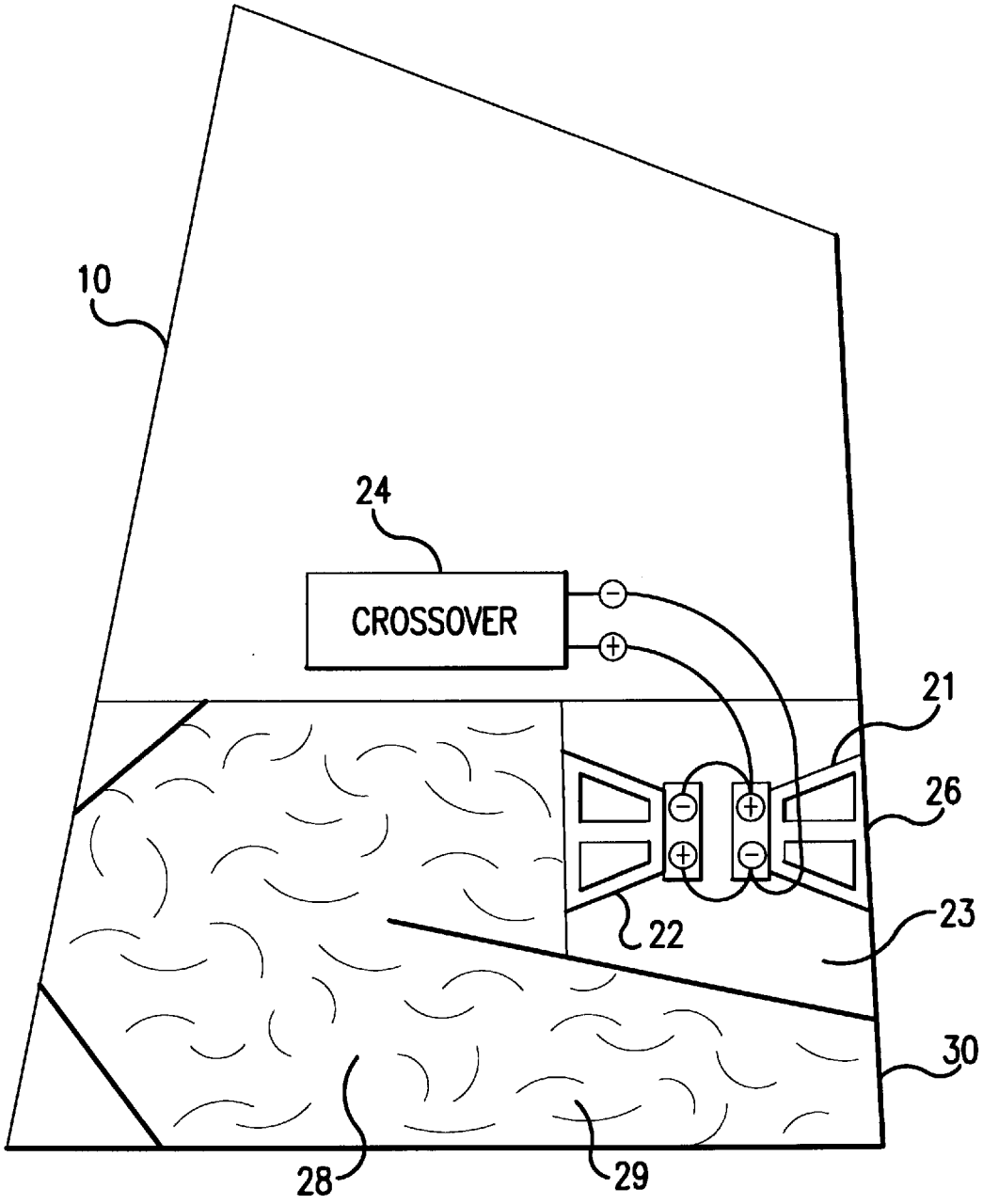
FIG. 1 is a cross sectional view of a loudspeaker system according to one preferred embodiment of the present invention.
Figure 1A:
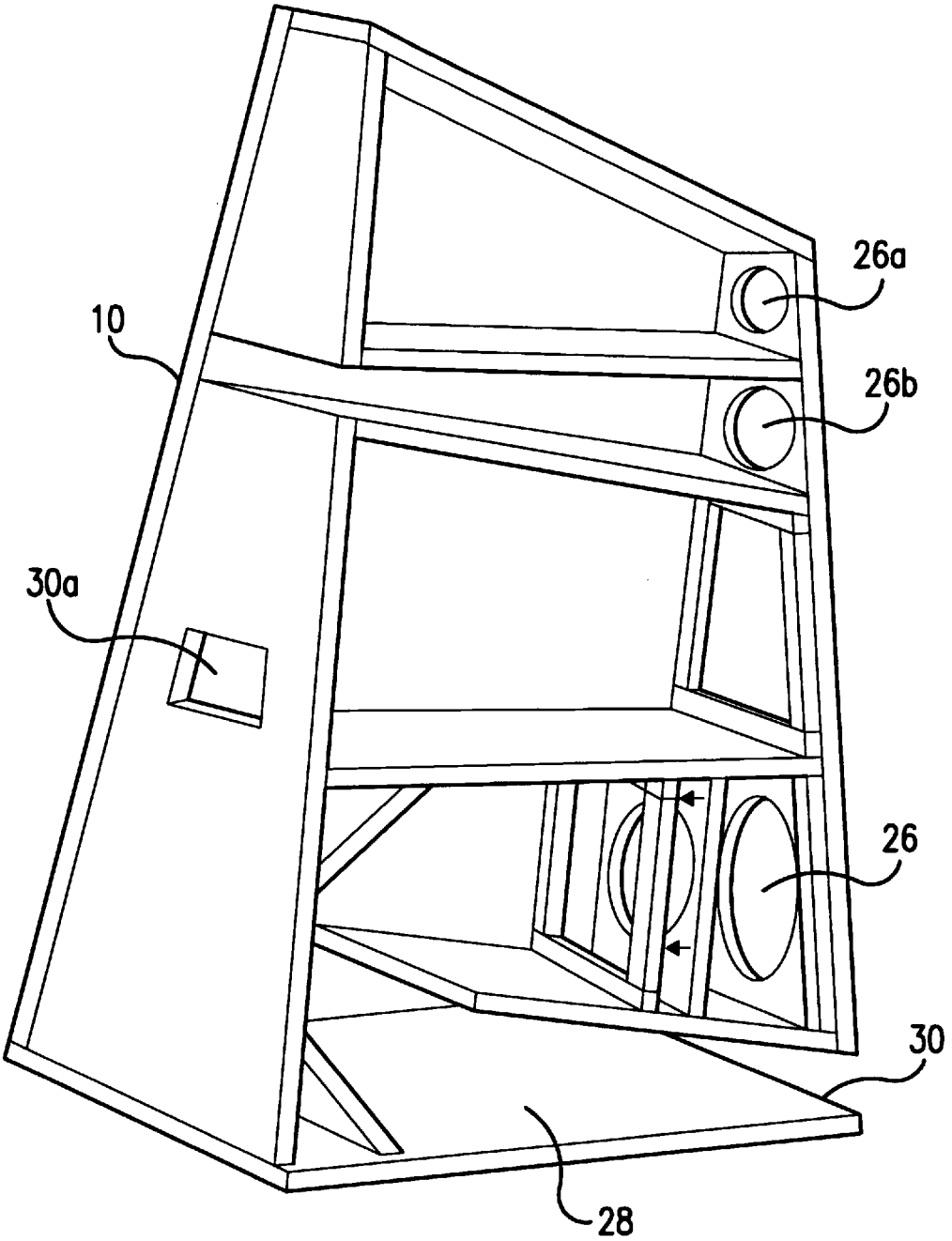
FIG. 1A is a perspective cut-away view of a loudspeaker cabinet according to one embodiment of the present invention.

Referring now to the figures, the present invention will be described in detail. As shown in FIGS. 1 and 1A, a multiple driver array includes a pair of loudspeaker drivers 21 and 22 coupled in a push-pull configuration in an airtight, sealed chamber or space 23 within loudspeaker cabinet or enclosure 10. The volume of the sealed space 23 is not critical, but it must be essentially air-tight. The push-pull array is loaded into an acoustic transmission line 28, which terminates at a port 30 in the front of the enclosure 10. An opening 26 is provided in the enclosure 10 for the output of the driver array. As shown, the drivers are connected together in series in a push-pull configuration, with the positive terminal of one driver connected to the negative terminal of the other driver and vice versa. An audio signal is connected to the terminals of the driver array from a conventional crossover circuit 24.

The operation of a crossover circuit is well known in the art and thus will not be explained in detail herein. In brief summary, the crossover circuit is used to separate the audio source signal into different frequency bands or ranges and to direct the separate sub-signals to different drivers (such as woofers, midrange drivers and tweeters, for example). FIG. 1 illustrates a woofer driver array only.

Figure 2A:
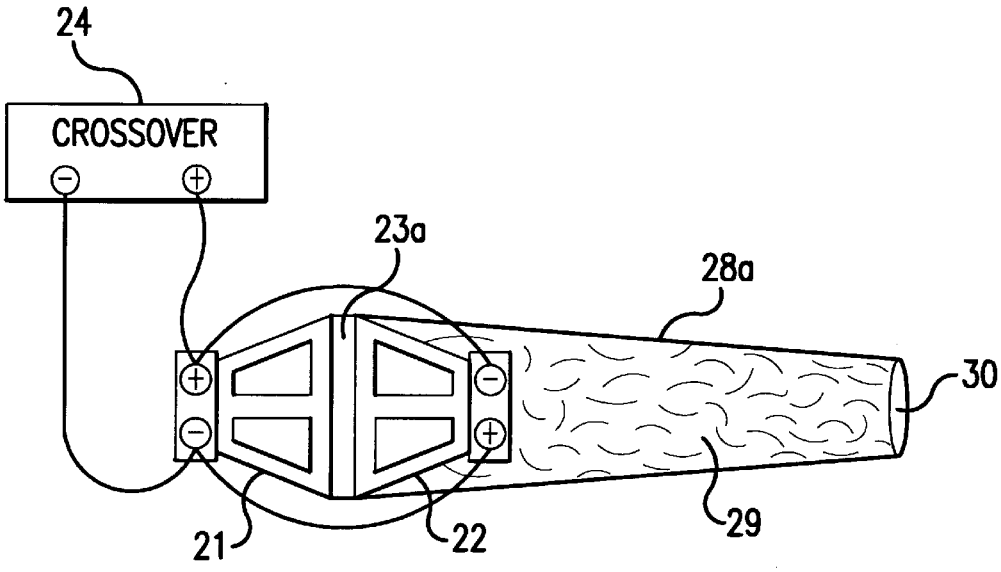
FIGS. 2A and 2B are side views of alternate two driver configurations according to the present invention.
Figure 2B:
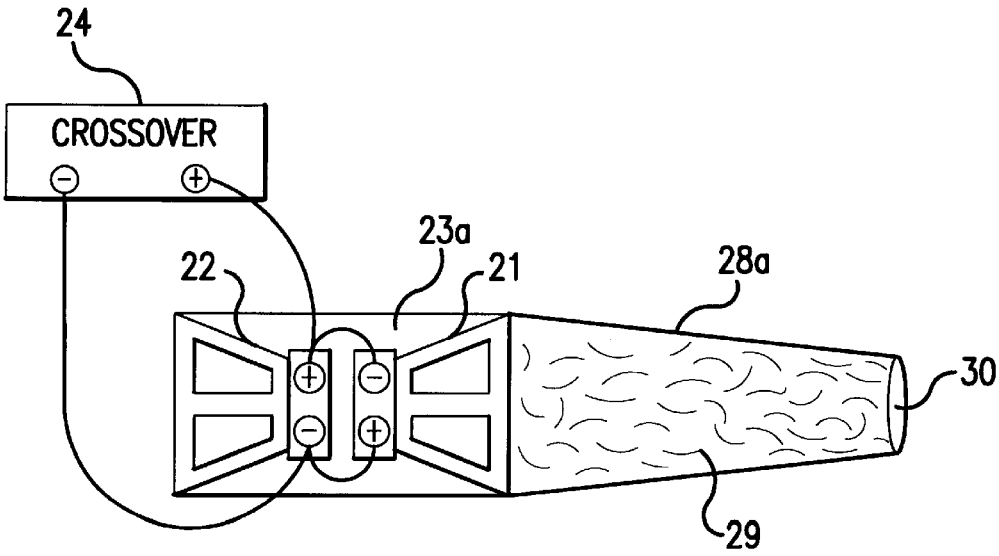

The acoustic transmission line 28 as shown is a folded, tapered line, but may be straight (as shown in FIGS. 2A and 2B as transmission line 28*a*), and can have parallel sides as well as tapered sides. However, a tapered transmission line is preferred because it provides a higher quality sound than a parallel sided line by more evenly distributing the resonant modes within the waveguide line. The taper should be decreasing from the driver end to the port end. The taper ratio (TR) is defined as the cross sectional area of the transmission line at the driver end divided by the cross sectional area of the line at the port end. A TR of at least 1.00 functions efficiently. The best results have been obtained with a TR of $\pi$ (3.1416). In fact, it has been discovered that a TR of $\pi$ improves performance even in a conventional transmission line enclosure. The reason for this is believed to be because $\pi$ is a non-repeating transcendental number, it therefore enables the transmission line to break down resonant frequencies out to an infinite number of harmonics. The transmission line can be of almost any cross sectional shape, but functions most effectively where there are no right angles or parallel sides.

The acoustic transmission line 28 is preferably filled with an acoustic damping material 29 to a predetermined density. Material 29 can be a fibrous material and/or open-celled acoustic foam. Long hair lambswool is preferred for most applications because of its high coefficient of absorption. The specific fill density is determined by the length of the transmission line, the average cross sectional area of the line, the Fs of the driver array, the Sd of the driver array, and the Qts of the driver array. The length of the transmission line is determined by the Fs of the driver array and the relative speed of the sound waves through the damping material, and can vary according to application. Typically, the length of the transmission line is set at either one quarter (¼), one half (½), three quarters (¾), or one full wavelength at the Fs of the driver array.

The damping material 29 serves three main purposes: (1) it acts as an acoustic low pass filter for the back wave of the driver array; (2) it damps resonant frequencies in the transmission line; and (3) it acts to delay the propagation of the sound waves traveling through the transmission line so that they emerge from the port 30 in proper phase relationship with the front wave of the driver array.

As shown in FIG. 1A, additional openings 26*a* and 26*b* are provided in the enclosure 10 for additional driver arrays. Opening 30*a* is provided for the crossover terminal plate to connect the speaker to an external amplifier.

The push-pull driver array may be configured in a face-to-face configuration as shown in FIG. 2A, with a sealed chamber 23*a* between the drivers, or may be arranged in a back-to-back configuration as shown in FIG. 2B, wherein the drivers 21 and 22 are enclosed in sealed chamber 23. In each case the drivers are connected to an audio signal from a crossover and the terminals of the individual drivers are connected so that the drivers act in series.

Figure 3:
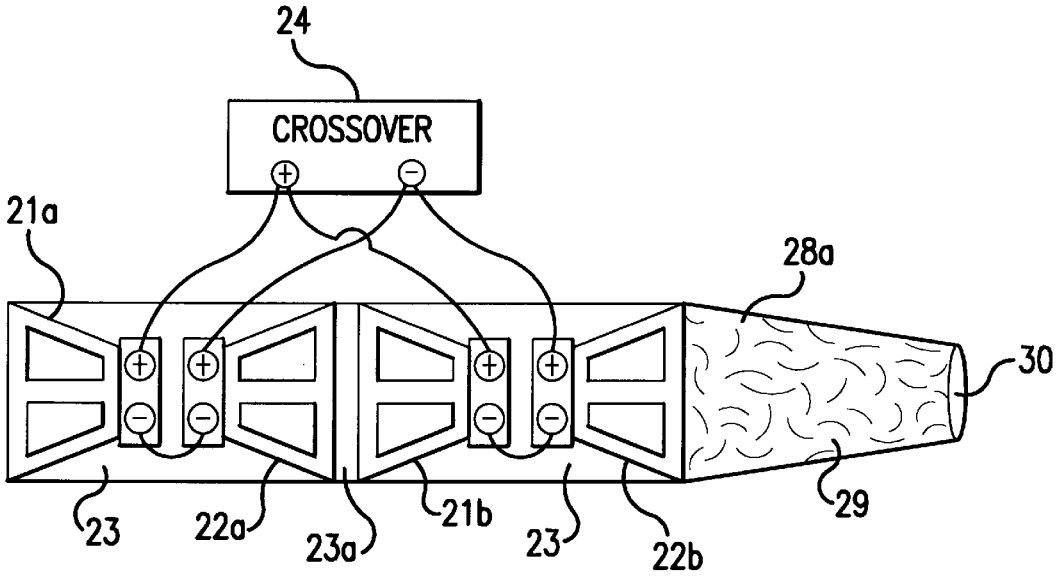
FIG. 3 is a side view of one alternate embodiment of the present invention comprising a four driver array.

While at least two drivers are required to achieve the push-pull transducing effect, there is no theoretical limit to the number of drivers which may be used in the driver array. FIG. 3 illustrates an alternate embodiment which uses four drivers 21*a*, 22*a*, 21*b* and 22*b* in a linear back-to-back, face-to-face, and back-to-back arrangement respectively. Drivers 21*a*, 22*a* and 21*b*, 22*b* are enclosed in sealed chambers 23, and the drivers 22*a* and 21*b* are coupled together by an airtight chamber 23*a*.

Figure 4:
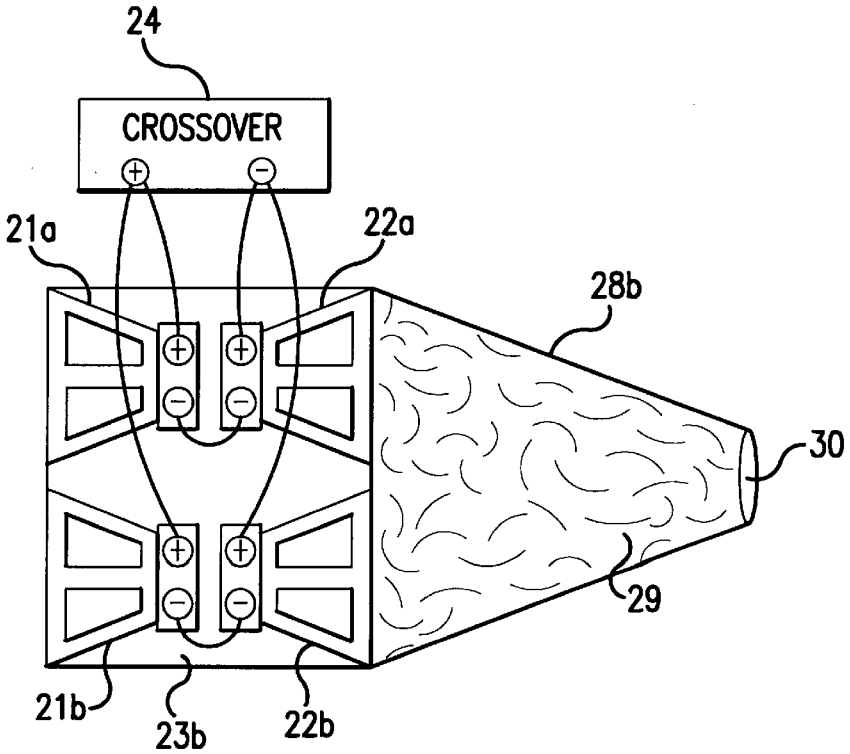
FIG. 4 is a side view of a second alternate embodiment of the present invention comprising a four driver array.

FIG. 4 shows a second alternate embodiment wherein the drivers 21*a*, 22*a*, 21*b* and 22*b* are arranged as two back-to-back pairs mounted adjacently to each other in an airtight sealed chamber 23*b*. A larger dimensioned acoustic transmission line 28*b* is provided in this embodiment to accommodate the dimension of the adjacent driver pair arrangement.

The present invention achieves many advantages over the prior art push-pull transducer system as well as over conventional transmission line arrangements. For example, the loudspeaker system according to the present invention exhibits an extended low frequency response, typically an $F_3$ 2–5 Hz below the Fs of the system. Additionally, the system has a flatter impedance curve with little or no rise at the Fs of the driver array, and also has a better transient response.

The push-pull acoustic transmission line arrangement acts more as a plane source propagator which minimizes listening room interaction, and further this arrangement loads the listening room instead of the loudspeaker enclosure. This allows music to "exist" in the listening room rather than inside the enclosure and thus provides a more vivid sound stage.

The present invention further exhibits a dramatic reduction in second order harmonic distortion over conventional acoustic transmission line systems caused by asymmetric non-linearities inherent in single driver operation. As applied to a bass driver, the present invention has a measurably lower bass frequency response ($F_3$) and the pitch and definition of the bass tones are significantly enhanced, resulting in more weight, authority and "slam" as compared with conventional systems. When used to reproduce midrange or high frequencies, the sound is more open and spatially vivid than obtained by conventional systems. The present invention further enables more seamless sound integration between bass, midrange and high frequency drivers.

It is to be understood that the embodiments of the invention presented herein are shown and described for the purposes of making a full disclosure of the preferred embodiments and that the embodiments presented are thus not limiting in any way as to the scope of the present invention, which is to be defined solely by the following claims.

What is claimed is:

1. A loudspeaker system, comprising:

an enclosure;

a transducer mounted in said enclosure and comprising at least two drivers arranged in a push-pull configuration and mounted to have an essentially airtight coupling therebetween;

first port in said enclosure coupled to an output of said transducer;

an acoustic transmission line provided within said enclosure, said transmission line being coupled at a first end thereof to said transducer and functioning as a load on said transducer and for damping sound waves generated by said transducer which enter said transmission line; and a second end of said acoustic transmission line terminating at a second port in said enclosure for transmitting said damped sound waves to the exterior of said enclosure through said second port.

2. A loudspeaker system according to claim 1, wherein said at least two drivers are arranged in a face-to-face push-pull configuration.

3. A loudspeaker system according to claim 1, wherein said at least two drivers are arranged in a back-to-back push-pull configuration.

4. A loudspeaker system according to claim 1, wherein said acoustic transmission line is tapered to have a decreasing cross-sectional area from said transducer to said second port.

5. A loudspeaker system according to claim 2, wherein said acoustic transmission line is filled with an acoustic damping material.

6. A loudspeaker system according to claim 1, wherein said acoustic transmission line is filled with an acoustic damping material.

7. A loudspeaker system according to claim 1, wherein said transducer comprises at least four drivers arranged in a push-pull configuration.

8. A loudspeaker system according to claim 7, wherein said at least four drivers are linearly arranged respectively in a back-to-back, face-to-face and back-to-back push-pull configuration.

9. A loudspeaker system according to claim 7, wherein said at least four drivers are arranged in two back-to-back pairs mounted adjacently to each other.

10. In a loudspeaker system having an enclosure, a transducer mounted in said enclosure and an acoustic transmission line provided within said enclosure and extending from said transducer to the exterior of said enclosure, the improvement comprising said acoustic transmission line being tapered to decrease in cross-sectional area from said transducer end to said exterior end, and having a taper ratio of $\pi$.

11. A loudspeaker system according to claim 4, wherein said tapered acoustic transmission line has a taper ratio of $\pi$.

12. In a loudspeaker system according to claim 10, further comprising the improvement wherein said transducer comprises at least two drivers arranged in a push-pull configuration.

13. A loudspeaker system, comprising:

an enclosure;

a transducer mounted in said enclosure and comprising at least two drivers arranged in a push-pull configuration and mounted to have an essentially airtight coupling therebetween;

a first port in said enclosure coupled to an output of said transducer;

an acoustic transmission line provided within said enclosure, said transmission line being coupled at a first end thereof to said transducer and terminating at a second end thereof to a second port in said enclosure, said acoustic transmission line being tapered to have a decreasing crosssectional area from said first end to said second end thereof.

* * * * *